United States Patent [19]

Urquhart

[11] 4,028,220

[45] June 7, 1977

[54] GAS EXTRACTION OF COAL

[75] Inventor: Donald Bremner Urquhart, Charlton Kings, England

[73] Assignee: Coal Industry (Patents) Limited, London, England

[22] Filed: Oct. 15, 1975

[21] Appl. No.: 622,737

[30] Foreign Application Priority Data

Nov. 19, 1974 United Kingdom ..... 50122/74

[52] U.S. Cl. ..... 208/8

[51] Int. Cl.[2] ..... C10G 1/04

[58] Field of Search ..... 208/8

[56] References Cited

UNITED STATES PATENTS

| | | | |
|---|---|---|---|
| 3,598,718 | 8/1971 | Gleim et al. | 208/8 |
| 3,607,716 | 9/1971 | Roach | 208/8 |
| 3,607,717 | 9/1971 | Roach | 208/8 |
| 3,642,607 | 2/1972 | Seitzer | 208/8 |
| 3,819,506 | 6/1974 | Seitzer et al. | 208/8 |
| 3,850,738 | 11/1974 | Stewart et al. | 208/8 |

OTHER PUBLICATIONS

Appell, H. R., "Solubilization of Low Rank Coal with Carbon Monoxide and Water", Chem. and Ind., No. 47, Nov. 22, 1969, p. 1703.

*Primary Examiner*—Delbert E. Gantz
*Assistant Examiner*—James W. Hellwege
*Attorney, Agent, or Firm*—Stevens, Davis, Miller & Mosher

[57] ABSTRACT

The present invention relates to hydrogenative extraction of coal, and relates to a process which comprises treating coal with water and carbon monoxide at a temperature within the range of 300° to 380° C., venting the gases to atmospheric pressure at the end of the treatment and thereafter extracting the hydrogenated coal with an extractant in the gas phase at a temperature of at least 400° C and thereafter separating the solid residue from the gas phase, recovering the coal extract from the extractant. The separation of the extract from the extractant is preferably carried out in the gas phase and it has been found that by arranging for the extractant medium to comprise one or more utilizable solvent components such that the sum of the reduced partial pressures of utilizable components of the extractant medium is at least one, enhanced separation and extraction of the coal is obtained and rapid separation of the extractant from the extract is obtained by simply reducing the pressure of the extractant medium.

8 Claims, No Drawings

GAS EXTRACTION OF COAL

The present invention relates to the gas extraction of coal and has particular reference to the hydrogenative extraction of coal using an extractant in the gas phase.

It has been proposed that coal can be extracted by treatment with carbon monoxide and water together with the extractant at an elevated temperature. The reaction can be carried out either in the presence of a catalyst or not depending upon the temperature of operation.

A disadvantage of the prior process is that severe corrosion of nickel structures and austenitic stainless steels is experienced in the reaction vessels in which the process is carried out and at the same time the working pressures are rather high.

According to the present invention, therefore, there is provided a process for the hydrogenative extraction of coal which comprises treating coal with water and carbon monoxide at a temperature within the range of 300° C. to 380° C., separating the gas from the treated coal at the end of the treatment, extracting the treated coal with an extractant in the gas phase at a temperature of at least 400° C. separating the solid residue from the gas phase and recovering the coal extract from the extractant. The gas pressure at the end of the treatment is preferably reduced to below 2 atmospheres. In a batchwise process the gas reducing gases may be vented to atmospheric pressure prior to supercritical extraction.

The hydrogenation is preferably carried out at a temperature within the range of 320° to 370° C. and at a pressure of 200 to 400 atmospheres. The period of treatment with the carbon monoxide and water is preferably one quarter of an hour to two hours, and more preferably three quarters of an hour to one and a half hours.

The coal material itself is preferably finely divided and it is preferred that more than 95% of the coal particles should pass through a 1.5 mm mesh sieve.

After the hydrogenation treatment the extraction is preferably carried out at a temperature within the range 400°–450° C.

The extractant may be a single constituent extractant or may be a mixture of individual extractants. The extractant medium may be added or introduced into contact with the treated coal material and need not necessarily consist entirely of solvent components which act as coal extractants but may incorporate one or more utilisable solvent components which are able to act as solvents or extractants under the prevailing conditions. The utilisable solvent components of the extractant are preferably selected from water, hydrocarbons, phenols and pyridine derivatives having a critical temperature of above 150° C. and preferably a critical temperature of below 450° C.

By "gas phase" as used in this specification it is to be understood a solvent which at the extraction temperature is above its critical temperature. Thus, in the case of an extractant comprised of a number of utilisable solvent components each individual solvent component will be above its critical temperature.

It will be appreciated therefore that the critical temperatures of the various solvent components is of some importance in this connection and it is preferred that the critical temperature of each such utilisable solvent component is greater than 250° C. and preferable that most solvent components for use in the present invention have a critical temperature of less than 400° C.

The utilisable solvent components are preferably each stable at the extraction temperature, that is to say, they should not decompose to any substantial extent at or below the extraction temperatures. The utilisable solvent components preferably do not react chemically with the coal residue or hydrogenation products or with any other of the utilisable solvent components or other substances present in the extraction chamber.

A single component solvent may be employed but in processes carried out on a commercial scale it is generally more practical and economical to employ a mixture of components as a solvent. A proportion of the solvent medium may be below the critical temperature and the reaction conditions may even remain in the liquid phase. This is not detrimental to the practice of the present invention but may result in some difficulty being experienced in recovering such a portion of the solvent medium on completion of the extraction.

The reaction products may include substances which can behave as utilisable solvent components themselves.

In a particular embodiment of the present invention the sum of the reduced partial pressures of the utilisable solvent components of the extraction medium having their critical temperatures between 150° C. and the extraction temperature itself is at least 1.

Typical solvents that may be used in the process of the present invention are aromatic hydrocarbons having a single benzene ring and preferably not more than four carbon atoms in substituent groups, for example, benzene, toluene, xylene, ethylbenzene, isopropyl benzene and tetramethyl benzene. Cycloaliphatic hydrocarbons may also be employed preferably those having at least five and not more than twelve carbon atoms in the chain, for example, cyclopentane, cyclohexane, and cis- and trans-decalin as well as alkylated derivatives thereof.

Aromatic hydrocarbons having two aromatic rings may be employed although it should be noted that their critical temperatures are relatively higher, for example, naphthalene, (critical temperature of 477° C.), methyl naphthale (critical temperature of 499° C.), biphenyl (critical temperature of 512° C.) and biphenylmethane (critical temperature of 497° C.). Acyclic aliphatic hydrocarbons preferably those having at least five carbon atoms and not more than sixteen carbon atoms may be employed, for example, hexanes, octanes, dodecanes and hexadecanes, the last, for example, having a critical temperature of 461° C. Such aliphatic hydrocarbons are preferably saturated; the corresponding alkenes would tend to be altered or undergo reaction under the extraction conditions. Phenols may also be used particularly those having up to eight carbon atoms, for example, phenol, anisole, and xylenol although the phenolic hydroxyl group may be liable to reduction under the extraction conditions. Heterocyclic amines such, for example, as pyridine may also be employed.

The proportion of extractant to treated coal material is preferably within the range of 5 to 10 times the original weight of coal prior to treatment. The ratio is preferably as low as possible for economic reasons but on the other hand, the more extractant present, the more reaction products are extracted from the treated coal material until an extractability limit is obtained.

It will be appreciated that the process may be operated batchwise or continuously. In a continuous process, the gases may not be vented as such, but are separated from the treated coal and the coal is then transferred to an extraction vessel.

The following is a description by way of example only of methods of carrying the invention into effect.

All the following Examples were carried out in a single 5 liter autoclave without intermediate cooling.

EXAMPLE 1

400 g coal containing 37.6 g of water together with 560 g of water was put in a 5 liter autoclave and pressurised to 860 p.s.i. with cold carbon monoxide. The temperature was raised to 340° C. over a period of 160 mins. The pressure was then 260 atmospheres and the contents of the autoclave were subjected to the reaction conditions for a period of two hours. At the end of the treatment period the gas was vented and 2.5 kg of toluene was pumped in and the temperature raised to 400° C. over a period of 1½ hours. Additional toluene (1.5 kg) was pumped through at a pressure of 120 atmospheres at the same rate as toluene extractant plus extract was removed from the autoclave. The pressure in the autoclave was then reduced to atmospheric over a period of 50 minutes.

The extract was recovered by distillation of the extractant from the extract.

The yield of coal residue was 215.1 g (59.5%) and the yield of extract was 113.6 g (31%). The extract did not distill at a pot temperature of 150° C. at a pressure of 60 torr.

EXAMPLE 2

Example 1 was repeated using 400 g of coal containing 32.4 g of water. The autoclave was was pressurised at to 800 p.s.i. (54 atmospheres) with cold carbon monoxide and the temperature raised initially to 320° C.

The yield of coal residue was 229.8 g (62.5%) and the yield of extract was 101.0 g (27.5%).

EXAMPLE 3

Example 1 was repeated using 400 g of coal having a water content of 36.8 g. This was charged together with 560 g of water into a 5 liter autoclave and carbon monoxide was introduced cold into the autoclave at a pressure of 1610 p.s.i. (110 atmospheres). The autoclave was heated to 320° C. over a period of 110 minutes to a terminal temperature of 240 atmospheres and the autoclave was cooked under these conditions for a further two hours. At the end of the treatment period the gas was vented and 2.5 kg of toluene was pumped in and the temperature raised to 400° C. over a period of 80 minutes. At the end of the initial heating an additional 1.5 kg of toluene was pumped through the autoclave at 400° C. (150 atmospheres pressure) and a corresponding amount of toluene and extract was removed from the autoclave. The autoclave was then vented to atmospheric pressure over a period of 60 minutes.

The extract was separated from the extractant in the manner described in Example 1.

The yield of residue was 208.0 g (57.2%) by weight and the yield of extract was 151.8 g (42%) by weight.

It will be noted that the process of the present invention permits the use of moderate working pressures around 250 atmospheres. It has previously been shown that the single stage process gives similar or lower yields of extract using working pressures of 400 atmospheres.

It has also been noted that the severe corrosion of nickel structures and austenitic stainless steels experienced with a single stage process is not noticed in the two stage process of the present invention and the corrosion experienced has been negligible.

I claim:

1. A process for the hydrogenative extraction of coal characterized by the combination of treating coal with water and carbon monoxide at a temperature within the range 300° C to 380° C in an initial hydrogenation step, separating the gases from the treated coal at the end of the treatment, extracting the treated coal with an extractant in the gas phase under supercritical conditions at a temperature of at least 400° C, separating the solid residue from the gas phase and recovering the coal extract from the extractant.

2. A process as claimed in claim 1 characterised in that the initial hydrogenation step is carried out at a temperature within the range of 320° to 370° C at a pressure of 200 to 400 atmospheres.

3. A process as claimed in claim 1 characterised in that the coal is in a finely divided state such that 95% of the coal particles pass a 1.5 mm mesh screen.

4. A process as claimed in claim 1 characterised in that the gas phase extraction is carried out at a temperature of 400° to 450° C.

5. A process as claimed in claim 1 characterised in that the extractant is an extractant medium containing one or more utilisable solvent components selected from water, hydrocarbons, phenols and pyridine derivatives having a critical temperature of above 150° C and below 450° C.

6. A process as claimed in claim 1 characterised in that the sum of the reduced partial pressure of the utilisable components of the extractant material medium is at least 1.

7. A process as claimed in claim 1 characterised in that the extractant medium comprises one or more utilisable solvent components selected from benzene ring compounds having not more than 4 carbon atoms in a substituent group, cycloaliphatic hydrocarbons having at least five and not more than twelve carbon atoms in a substituent group, alkylated derivatives thereof, aromatic hydrocarbons having two aromatic rings, phenols containing up to eight carbon atoms and heterocyclic amines of the pyridine type.

8. A process as claimed in claim 1 wherein the proportion of extractant is within the range of 2 to 10 times the original weight of coal prior to treatment.

* * * * *